US012269659B2

(12) United States Patent
Sachs et al.

(10) Patent No.: US 12,269,659 B2
(45) Date of Patent: Apr. 8, 2025

(54) FOIL FREE TABBED SEAL

(71) Applicant: Selig Sealing Products, Inc., Forrest, IL (US)

(72) Inventors: Victor Sachs, Surrey (GB); Rafael Zamora, Oberglatt (CH)

(73) Assignee: Selig Sealing Products, Inc., Forrest, IL (US)

( * ) Notice: Subject to any disclaimer, the term of this patent is extended or adjusted under 35 U.S.C. 154(b) by 0 days.

(21) Appl. No.: 17/779,276

(22) PCT Filed: Nov. 25, 2020

(86) PCT No.: PCT/US2020/062172

§ 371 (c)(1),
(2) Date: May 24, 2022

(87) PCT Pub. No.: WO2021/108506

PCT Pub. Date: Jun. 3, 2021

(65) Prior Publication Data

US 2022/0411146 A1 Dec. 29, 2022

Related U.S. Application Data

(60) Provisional application No. 62/941,915, filed on Nov. 29, 2019.

(51) Int. Cl.
*B65D 53/04* (2006.01)

(52) U.S. Cl.
CPC ..... *B65D 53/04* (2013.01); *B65D 2251/20* (2013.01); *B65D 2577/205* (2013.01)

(58) Field of Classification Search
CPC .... B65D 77/2032; B65D 7/01; B65D 7/2878; B65D 51/20; B65D 77/2024;
(Continued)

(56) References Cited

U.S. PATENT DOCUMENTS 1,818,379 A 8/1931 Cain
2,768,762 A 10/1956 Guinet
(Continued)

FOREIGN PATENT DOCUMENTS

AT 501393 A1 8/2006
AT 11738 U1 4/2011
(Continued)

OTHER PUBLICATIONS

Patent Cooperation Treaty, International Search Report and Written Opinion for International Application No. PCT/US2020/062172 dated Feb. 12, 2021, 8 pages.

*Primary Examiner* — Steven A. Reynolds
*Assistant Examiner* — Prince Pal
(74) *Attorney, Agent, or Firm* — Fitch, Even, Tabin & Flannery, LLP

(57) ABSTRACT

Various forms of tabbed sealing members are described along with the laminates from which the sealing members are formed. In some forms, the tabbed sealing members may generally be formed from materials that may be processed using a single recycling stream. In one form, the tabbed seals do not include any metal foils, such as would traditionally be included in induction heated seals. Instead, the seals may be applied in other manners, such as using ultrasonic sealing, conduction heating, high frequency sealing/welding, pressure sensitive adhesives, and the like.

23 Claims, 5 Drawing Sheets

(58) Field of Classification Search
CPC .... B65D 2251/0093; B65D 2251/2577; B65D 2251/205
USPC ..... 220/270
See application file for complete search history.

(56) References Cited

U.S. PATENT DOCUMENTS 3,235,165 A 2/1966 Jackson
3,292,828 A 12/1966 Stuart
3,302,818 A 2/1967 Balocca et al.
3,460,310 A 8/1969 Adcock et al.
3,556,816 A 1/1971 Nughes
3,964,670 A 6/1976 Amneus
3,990,603 A 11/1976 Brochman
4,022,324 A * 5/1977 Schuster ..... B65D 81/28 206/439
4,133,796 A 1/1979 Bullman
4,206,165 A 6/1980 Dukess
4,266,687 A 5/1981 Cummings
4,396,655 A 8/1983 Graham
4,556,590 A 12/1985 Martin
4,582,735 A 4/1986 Smith
4,588,099 A 5/1986 Diez
4,595,116 A 6/1986 Carlsson
4,596,338 A * 6/1986 Yousif ..... B65D 53/04 215/261
4,636,273 A 1/1987 Wolfersperger
4,666,052 A * 5/1987 Ou-Yang ..... B65D 55/066 428/467
4,693,390 A 9/1987 Hekal
4,735,335 A 4/1988 Torterotot
4,741,791 A 5/1988 Howard
4,756,917 A * 7/1988 Kamada ..... B32B 7/06 428/457
4,762,246 A 8/1988 Ashley
4,770,325 A 9/1988 Gordon
4,771,903 A 9/1988 Levene
4,778,698 A * 10/1988 Ou-Yang ..... B65D 51/20 428/458
4,781,294 A 11/1988 Croce
4,784,885 A * 11/1988 Carespodi ..... B65D 77/2032 428/476.1
4,801,647 A 1/1989 Wolfe, Jr.
4,811,856 A 3/1989 Fischman
4,818,577 A 4/1989 Ou-Yang
4,837,061 A 6/1989 Smits
4,863,061 A 9/1989 Moore
4,867,881 A 9/1989 Kinzer
4,889,731 A 12/1989 Williams
4,917,949 A 4/1990 Yousif
4,934,544 A 6/1990 Han
4,938,390 A 7/1990 Markva
4,960,216 A * 10/1990 Giles ..... B65D 51/20 220/258.2
4,961,986 A * 10/1990 Galda ..... B65D 51/20 215/250
5,004,111 A 4/1991 McCarthy
5,012,946 A 5/1991 McCarthy
5,015,318 A 5/1991 Smits
5,053,457 A 10/1991 Lee
5,055,150 A 10/1991 Rosenfeld
5,057,365 A 10/1991 Finkelstein
5,071,710 A 12/1991 Smits
5,089,320 A 2/1992 Straus
5,098,495 A 3/1992 Smits
RE33,893 E 4/1992 Elias
5,106,124 A 4/1992 Volkman
5,125,529 A 6/1992 Torterotot
5,131,556 A 7/1992 Iioka
5,149,386 A 9/1992 Smits
5,178,967 A 1/1993 Rosenfeld
5,197,618 A 3/1993 Goth
5,217,790 A 6/1993 Galda
5,226,281 A 7/1993 Han
5,261,990 A 11/1993 Galda
5,265,745 A * 11/1993 Pereyra ..... B65D 77/204 215/258
5,433,992 A 7/1995 Galda
5,513,781 A 5/1996 Ullrich
5,514,442 A 5/1996 Galda
5,560,989 A * 10/1996 Han ..... B29C 66/83413 220/359.3
5,598,940 A 2/1997 Finkelstein
5,601,200 A 2/1997 Finkelstein
5,615,789 A 4/1997 Finkelstein
5,618,618 A 4/1997 Murschall
5,669,521 A 9/1997 Wiening
5,683,774 A 11/1997 Faykish
5,702,015 A 12/1997 Giles
5,709,310 A 1/1998 Kretz
5,720,401 A * 2/1998 Moore ..... B65D 51/20 215/349
5,759,650 A * 6/1998 Raines ..... A23L 3/3427 426/123
5,776,284 A 7/1998 Sykes
5,851,333 A 12/1998 Fagnant
5,860,544 A 1/1999 Brucker
5,871,112 A 2/1999 Giles
5,887,747 A 3/1999 Burklin
5,915,577 A 6/1999 Levine
5,975,304 A 11/1999 Cain
5,976,294 A 11/1999 Fagnant
6,036,803 A * 3/2000 Lasson ..... B65D 5/727 156/244.11
6,056,141 A 5/2000 Navarini
6,082,566 A 7/2000 Yousif
6,096,358 A 8/2000 Murdick
6,131,754 A * 10/2000 Smelko ..... B65D 53/02 428/458
6,139,931 A 10/2000 Finkelstein
6,158,632 A 12/2000 Ekkert
6,194,042 B1 2/2001 Finkelstein
6,234,386 B1 5/2001 Drummond
6,290,801 B1 9/2001 Krampe
6,312,776 B1 11/2001 Finkelstein
6,361,856 B1 3/2002 Wakai
6,378,715 B1 4/2002 Finkelstein
6,458,302 B1 10/2002 Shifflet
6,461,714 B1 10/2002 Giles
6,544,615 B2 4/2003 Otten
6,548,302 B1 4/2003 Mao
6,602,309 B2 8/2003 Vizulis
6,627,273 B2 9/2003 Wolf
6,635,137 B2 10/2003 Giles
6,669,046 B1 12/2003 Sawada
6,699,566 B2 3/2004 Zeiter
6,705,467 B1 3/2004 Kancsar
6,722,272 B2 4/2004 Jud
6,767,425 B2 7/2004 Meier
6,790,508 B2 9/2004 Razeti
6,866,926 B1 * 3/2005 Smelko ..... B32B 5/18 428/319.3
6,902,075 B2 6/2005 Obrien
6,916,516 B1 7/2005 Gerber
6,955,736 B2 10/2005 Rosenberger
6,959,832 B1 11/2005 Sawada
6,974,045 B1 * 12/2005 Trombach ..... B65D 51/20 215/349
6,986,930 B2 1/2006 Giles
7,128,210 B2 10/2006 Razeti
7,182,475 B2 2/2007 Kramer
7,217,454 B2 5/2007 Smelko
RE39,790 E 8/2007 Fuchs
7,316,760 B2 1/2008 Nageli
7,448,153 B2 11/2008 Maliner
7,531,228 B2 5/2009 Perre
7,648,764 B2 1/2010 Yousif
7,713,605 B2 5/2010 Yousif
7,731,048 B2 6/2010 Teixeira Alvares
7,740,730 B2 6/2010 Schedl
7,740,927 B2 * 6/2010 Yousif ..... B65D 51/20 428/40.1

(56) References Cited

U.S. PATENT DOCUMENTS 7,757,879 B2 7/2010 Schuetz
7,789,262 B2 9/2010 Niederer
7,798,359 B1 9/2010 Marsella
7,819,266 B2 10/2010 Ross
7,838,109 B2 11/2010 Declerck
7,850,033 B2 * 12/2010 Thorstensen-Woll ..... B65D 53/04 220/359.3
8,025,171 B2 9/2011 Cassol
8,057,896 B2 11/2011 Smelko
8,129,009 B2 3/2012 Morris
8,201,385 B2 6/2012 McLean
8,308,003 B2 11/2012 O'Brien
8,329,288 B2 * 12/2012 Allegaert ..... B32B 5/18 428/319.3
8,348,082 B2 1/2013 Cain
8,354,050 B2 * 1/2013 Abrams ..... B29C 45/14811 264/250
8,455,071 B2 * 6/2013 Lo ..... B65D 51/22 428/36.5
8,541,081 B1 9/2013 Ranganathan
8,703,265 B2 * 4/2014 Thorstensen-Woll ..... G09F 3/0341 215/230
8,715,825 B2 5/2014 Thorstensen-Woll
8,852,725 B2 * 10/2014 Sachs ..... B65D 51/20 156/364
8,906,185 B2 12/2014 McLean
8,944,264 B2 2/2015 Frishman
9,012,005 B2 * 4/2015 Abrams ..... B32B 25/16 428/95
9,028,963 B2 5/2015 Thorstensen-Woll
9,102,438 B2 8/2015 Thorstensen-Woll
9,120,289 B2 * 9/2015 Chang ..... B32B 7/14
9,132,947 B2 * 9/2015 Wiening ..... B32B 7/10
9,175,436 B2 * 11/2015 Abrams ..... B32B 27/286
9,193,513 B2 11/2015 Thorstensen-Woll
9,221,579 B2 * 12/2015 Thorstensen-Woll ..... B65D 51/005
9,227,755 B2 1/2016 Thorstensen-Woll
9,278,506 B2 3/2016 McLean
9,278,793 B2 3/2016 Thorstensen-Woll
9,302,796 B2 * 4/2016 Averett ..... B65D 53/04
9,440,765 B2 9/2016 Thorstensen-Woll
9,440,766 B2 * 9/2016 Wiening ..... B65D 41/045
9,440,768 B2 9/2016 Thorstensen-Woll
9,533,805 B2 * 1/2017 McLean ..... B65D 39/025
9,637,288 B2 * 5/2017 Abegglen ..... B65D 51/228
9,676,513 B2 6/2017 Thorstensen-Woll
9,834,339 B2 12/2017 Brucker
9,908,658 B2 * 3/2018 Jouin ..... B65D 77/2024
9,956,741 B2 * 5/2018 Planchard ..... B32B 27/12
9,994,357 B2 6/2018 Thorstensen-Woll
10,000,310 B2 6/2018 Thorstensen-Woll
10,150,590 B2 12/2018 Thorstensen-Woll
10,196,174 B2 2/2019 Thorstensen-Woll
10,259,626 B2 4/2019 Thorstensen-Woll
10,549,510 B2 * 2/2020 Ettridge ..... B32B 38/0008
10,556,732 B2 2/2020 Cassidy
10,604,315 B2 * 3/2020 Thorstensen-Woll ..... B65D 77/2056
10,882,673 B2 * 1/2021 Shah ..... B65D 49/12
10,899,506 B2 * 1/2021 Thorstensen-Woll ..... B65D 77/2056
10,934,069 B2 * 3/2021 Clark ..... B32B 27/065
10,954,032 B2 3/2021 Thorstensen-Woll
10,968,017 B2 * 4/2021 Shi ..... B32B 27/36
11,059,644 B2 7/2021 Cassidy
11,254,481 B2 * 2/2022 Zamora ..... B65D 51/20
11,285,695 B2 * 3/2022 Brumbaugh ..... B65D 65/14
11,498,316 B2 * 11/2022 Dietrich ..... B32B 7/06
11,708,198 B2 * 7/2023 Thorstensen-Woll .... B32B 7/05 220/258.2
11,724,863 B2 * 8/2023 Thorstensen-Woll .... B32B 3/08 215/200
2001/0023870 A1 9/2001 Mihalov
2001/0031348 A1 10/2001 Jud
2001/0049001 A1 * 12/2001 Mueller ..... B32B 7/06 428/352
2002/0028326 A1 3/2002 Lhila
2002/0068140 A1 6/2002 Finkelstein
2003/0087057 A1 5/2003 Blemberg
2003/0108714 A1 6/2003 Razeti
2003/0168423 A1 9/2003 Williams
2003/0196418 A1 10/2003 O'Brien
2004/0013862 A1 1/2004 Brebion
2004/0028851 A1 2/2004 Okhai
2004/0043165 A1 3/2004 Van Hulle
2004/0043238 A1 3/2004 Wuest
2004/0071934 A1 * 4/2004 Giles ..... B65D 53/04 428/126
2004/0109963 A1 6/2004 Zaggia
2004/0197500 A9 10/2004 Swoboda
2004/0211320 A1 10/2004 Cain
2005/0003155 A1 1/2005 Huffer
2005/0048307 A1 3/2005 Schubert
2005/0100718 A1 5/2005 Peiffer et al.
2005/0208242 A1 9/2005 Smelko
2005/0208244 A1 9/2005 Delmas
2005/0218143 A1 10/2005 Niederer
2005/0279814 A1 12/2005 Drummond
2006/0000545 A1 1/2006 Nageli
2006/0003120 A1 * 1/2006 Nageli ..... B32B 7/12 428/35.2
2006/0003122 A1 1/2006 Nageli
2006/0068163 A1 3/2006 Giles
2006/0124577 A1 6/2006 Ross
2006/0151415 A1 7/2006 Smelko
2006/0278665 A1 12/2006 Bennett
2007/0003725 A1 1/2007 Yousif
2007/0007229 A1 1/2007 Yousif
2007/0014897 A1 1/2007 Ramesh
2007/0051690 A1 * 3/2007 Hidding ..... B65D 41/3409 220/258.1
2007/0065609 A1 3/2007 Korson
2007/0164094 A1 * 7/2007 Takahashi ..... B65D 77/2044 229/123.1
2007/0267304 A1 11/2007 Portier
2007/0290012 A1 * 12/2007 Jackman ..... B65D 51/20 222/541.4
2007/0298273 A1 12/2007 Thies
2008/0026171 A1 1/2008 Gullick
2008/0073308 A1 * 3/2008 Yousif ..... B65D 51/18 220/359.3
2008/0103262 A1 5/2008 Haschke
2008/0135159 A1 6/2008 Bries
2008/0145581 A1 6/2008 Tanny
2008/0156443 A1 7/2008 Schaefer
2008/0169286 A1 7/2008 McLean
2008/0231922 A1 * 9/2008 Thorstensen-Woll .... B32B 7/12 359/2
2008/0233339 A1 9/2008 Thorstensen-Woll
2008/0233424 A1 9/2008 Thorstensen-Woll
2009/0078671 A1 * 3/2009 Triquet ..... B65D 53/04 29/592
2009/0208729 A1 8/2009 Allegaert
2009/0304964 A1 12/2009 Sachs
2010/0009162 A1 1/2010 Rothweiler
2010/0030180 A1 2/2010 Deckerck
2010/0047552 A1 * 2/2010 McLean ..... B32B 37/203 428/317.1
2010/0059942 A1 3/2010 Rothweiler
2010/0089860 A1 * 4/2010 Wiggins ..... B65D 51/225 215/47
2010/0116410 A1 5/2010 Yousif
2010/0155288 A1 6/2010 Harper
2010/0170820 A1 * 7/2010 Leplatois ..... B32B 27/306 156/324
2010/0193463 A1 8/2010 Obrien
2010/0213193 A1 8/2010 Helmlinger
2010/0221483 A1 9/2010 Gonzalez Carro

(56) References Cited

U.S. PATENT DOCUMENTS

2010/0279041 A1 11/2010 Mathew
2010/0290663 A1 11/2010 Trassl
2010/0314278 A1 12/2010 Fonteyne
2011/0000917 A1 1/2011 Wolters
2011/0005961 A1 1/2011 Leplatois
2011/0049002 A1* 3/2011 Georgelos ..... B65D 77/2024 428/521
2011/0089177 A1 4/2011 Thorstensen-Woll
2011/0091715 A1 4/2011 Rakutt
2011/0100949 A1 5/2011 Grayer
2011/0100989 A1* 5/2011 Cain ..... B29C 66/83415 220/270
2011/0138742 A1* 6/2011 McLean ..... B32B 3/02 53/329.2
2011/0147353 A1 6/2011 Kornfeld
2011/0152821 A1 6/2011 Kornfeld
2012/0000910 A1 1/2012 Ekkert
2012/0043330 A1 2/2012 McLean et al.
2012/0067896 A1 3/2012 Daffner
2012/0070636 A1* 3/2012 Thorstensen-Woll ..... B65D 17/4011 428/335
2012/0077029 A1* 3/2012 Troutman ..... B32B 7/12 428/352
2012/0103988 A1* 5/2012 Wiening ..... B65D 51/20 220/260
2012/0111758 A1* 5/2012 Lo ..... B65D 51/22 206/524.6
2012/0241449 A1 9/2012 Frischmann
2012/0241458 A1* 9/2012 Boiron ..... B65D 77/2024 220/359.3
2012/0285920 A1* 11/2012 McLean ..... B32B 38/1841 156/271
2012/0288693 A1 11/2012 Stanley
2012/0312818 A1* 12/2012 Ekkert ..... B65D 41/045 220/258.2
2013/0020324 A1 1/2013 Thorstensen-Woll
2013/0020328 A1 1/2013 Duan
2013/0045376 A1 2/2013 Chen
2013/0121623 A1 5/2013 Lyzenga
2013/0177263 A1 7/2013 Duan
2013/0248410 A9 9/2013 Spallek
2014/0001185 A1 1/2014 McLean
2014/0037916 A1* 2/2014 Reilly ..... B32B 23/08 428/200
2014/0037940 A1* 2/2014 Fujimura ..... B32B 27/18 428/328
2014/0061196 A1* 3/2014 Thorstensen-Woll .... B32B 3/30 220/270
2014/0061197 A1 3/2014 Thorstensen-Woll
2014/0186589 A1 7/2014 Chang
2014/0224800 A1* 8/2014 Thorstensen-Woll ..... G09F 3/0341 220/255
2014/0284331 A1 9/2014 Thorstensen-Woll
2014/0326727 A1 11/2014 Jouin
2015/0053680 A1 2/2015 Yuno
2015/0083723 A1* 3/2015 Thorstensen-Woll ..... A61K 39/3955 220/259.3
2015/0131926 A1 5/2015 Lux
2015/0158643 A1 6/2015 Coker
2015/0197385 A1 7/2015 Wei
2015/0225116 A1* 8/2015 Thorstensen-Woll ..... B65D 17/501 220/258.2
2015/0291342 A1* 10/2015 Mack ..... B65D 51/1638 426/107
2015/0321808 A1* 11/2015 Thorstensen-Woll ..... B65D 51/20 215/232
2015/0368000 A1* 12/2015 Price ..... B65D 51/20 215/350
2016/0001952 A1 1/2016 Kulkarni
2016/0159546 A1 6/2016 Cassidy
2016/0185485 A1 6/2016 Thorstensen-Woll
2016/0325896 A1* 11/2016 Thorstensen-Woll ..... B65D 51/185
2017/0173930 A1 6/2017 McLean
2017/0253373 A1 9/2017 Thorstensen-Woll
2017/0259978 A1 9/2017 Zamora
2017/0291399 A1* 10/2017 Bourgeois ..... B29C 66/8322
2018/0079576 A1* 3/2018 Cassidy ..... B65D 77/2024
2018/0118439 A1* 5/2018 Thorstensen-Woll ..... B32B 27/32
2018/0186122 A1* 7/2018 Bourgeois ..... B29C 65/76
2019/0055070 A1* 2/2019 Brown ..... B65D 53/08
2019/0092520 A1 3/2019 Thorstensen-Woll
2019/0225369 A1 7/2019 Thorstensen-Woll
2019/0270547 A1* 9/2019 Thorstensen-Woll ..... B65D 55/06
2019/0276209 A1* 9/2019 Clark ..... B65D 53/04
2020/0079561 A1* 3/2020 Zamora ..... B65D 51/20
2020/0087056 A1 3/2020 Bosetti
2020/0108987 A1* 4/2020 De La Vega Sudan ..... B32B 27/32
2020/0216256 A1 7/2020 Miozzo
2020/0277121 A1* 9/2020 Wei ..... B65D 53/04
2020/0282708 A1 9/2020 Leuer
2021/0188489 A1 6/2021 Thorstensen-Woll
2021/0237951 A1 8/2021 Ostergren
2021/0292059 A1 9/2021 Thorstensen-Woll
2021/0292060 A1* 9/2021 Thorstensen-Woll ..... B65D 51/20
2022/0152999 A1* 5/2022 Priscal ..... B32B 7/05
2022/0194681 A1* 6/2022 Schell ..... B32B 27/20
2022/0227554 A1* 7/2022 Lehrter ..... B32B 27/18
2022/0274759 A1* 9/2022 Wegenberger ..... B32B 7/12
2022/0355574 A1* 11/2022 Yee ..... B32B 27/32
2022/0411146 A1* 12/2022 Sachs ..... B65D 51/20
2023/0088010 A1* 3/2023 Francklow ..... B65D 77/2024
2023/0094210 A1* 3/2023 Zamora ..... B32B 15/082 215/295
2023/0182457 A1* 6/2023 Utz ..... B65D 75/008 428/35.4

FOREIGN PATENT DOCUMENTS

AU 2021328601 A1 3/2023
BR 8200231 U 9/2003
BR 0300992 A 11/2004
CA 2015992 A1 1/1991
CA 2203744 A1 10/1997
CA 2297840 A1 2/1999
CN 1301289 A 6/2001
CN 1639020 A 7/2005
CN 103193026 A 7/2013
CN 104853994 A 8/2015
CN 108238366 A 7/2018
CN 108481851 A 9/2018
CN 208070440 U 11/2018
CN 210794267 U 6/2020
CN 211077015 U 7/2020
CN 111605889 A 9/2020
CN 113423649 A 9/2021
CN 115179627 A 10/2022
DE 102006030118 B3 5/2007
DE 10204281 A1 8/2007
DE 102007022935 B4 4/2009
DE 202009000245 U1 4/2009
DE 102013015581 B3 10/2014
DE 102020131929 A1 6/2022
DE 102020133989 A1 6/2022
EP 0135431 A1 3/1985
EP 0577432 A1 1/1994
EP 0668221 A1 8/1995
EP 0826598 A2 3/1998
EP 0826599 A2 3/1998
EP 0905039 A1 3/1999
EP 0717710 B1 4/1999
EP 0915026 A1 5/1999

(56) References Cited

FOREIGN PATENT DOCUMENTS

| | | | |
|---|---|---|---|
| EP | 0706473 | B1 | 8/1999 |
| EP | 1075921 | A2 | 2/2001 |
| EP | 1199253 | A2 | 4/2002 |
| EP | 0803445 | B1 | 11/2003 |
| EP | 1462381 | A1 | 9/2004 |
| EP | 1199253 | B1 | 3/2005 |
| EP | 1577226 | A1 | 9/2005 |
| EP | 1814744 | A1 | 8/2007 |
| EP | 1834893 | A1 | 9/2007 |
| EP | 1837288 | A1 | 9/2007 |
| EP | 1839898 | A1 | 10/2007 |
| EP | 1839899 | A1 | 10/2007 |
| EP | 1857275 | A1 | 11/2007 |
| EP | 1873078 | A1 | 1/2008 |
| EP | 1445209 | B1 | 5/2008 |
| EP | 1918094 | A1 | 5/2008 |
| EP | 1935636 | A1 | 6/2008 |
| EP | 1968020 | A1 | 9/2008 |
| EP | 1992476 | A1 | 11/2008 |
| EP | 2014461 | A1 | 1/2009 |
| EP | 2230190 | A1 | 9/2010 |
| EP | 2292524 | A1 | 3/2011 |
| EP | 2599735 | A1 | 6/2013 |
| EP | 2230190 | B1 | 8/2014 |
| EP | 2778090 | A1 | 9/2014 |
| EP | 3587297 | A1 | 1/2020 |
| EP | 3615325 | A1 | 3/2020 |
| EP | 3278972 | B1 | 10/2020 |
| EP | 3829869 | A2 | 6/2021 |
| EP | 3887275 | A1 | 10/2021 |
| EP | 3898219 | A1 | 10/2021 |
| EP | 3946936 | A1 | 2/2022 |
| EP | 3969276 | A1 | 3/2022 |
| EP | 3986711 | A1 | 4/2022 |
| EP | 3995307 | A1 | 5/2022 |
| EP | 3997268 | A1 | 5/2022 |
| EP | 4038131 | A1 | 8/2022 |
| EP | 4151549 | A1 | 3/2023 |
| EP | 4161777 | A1 | 4/2023 |
| EP | 4194361 | A1 | 6/2023 |
| FR | 2693986 | A1 | 1/1994 |
| FR | 2916157 | A1 | 11/2008 |
| FR | 2943322 | A1 | 9/2010 |
| GB | 1216991 | A | 12/1970 |
| GB | 2353986 | A | 3/2001 |
| GB | 2501967 | A | 11/2013 |
| JP | H09110077 | A | 4/1997 |
| JP | 2004212778 | A | 7/2004 |
| JP | 2014015249 | | 1/2014 |
| KR | 100711073 | B1 | 4/2007 |
| KR | 100840926 | B1 | 6/2008 |
| KR | 100886955 | B1 | 3/2009 |
| KR | 102501281 | B1 | 2/2023 |
| MX | 05002905 | A | 2/2006 |
| MX | 2010001867 | A | 4/2010 |
| TW | 201217237 | A | 5/2012 |
| WO | 97/02997 | A1 | 1/1997 |
| WO | 9905041 | A1 | 2/1999 |
| WO | 0066450 | A1 | 11/2000 |
| WO | 2005009868 | A1 | 2/2005 |
| WO | 2005030860 | A1 | 4/2005 |
| WO | 2006018556 | A1 | 2/2006 |
| WO | 2006021291 | A1 | 3/2006 |
| WO | 2006073777 | A1 | 7/2006 |
| WO | 2006108853 | A1 | 10/2006 |
| WO | 2008027029 | A2 | 3/2008 |
| WO | 2008027036 | A1 | 3/2008 |
| WO | 2008039350 | A2 | 4/2008 |
| WO | 2008/113855 | A1 | 9/2008 |
| WO | 2008118569 | A2 | 10/2008 |
| WO | 2008125784 | A1 | 10/2008 |
| WO | 2008125785 | A1 | 10/2008 |
| WO | 2008148176 | A1 | 12/2008 |
| WO | 2009092066 | A2 | 7/2009 |
| WO | 2010115811 | A1 | 10/2010 |
| WO | 2011039067 | A1 | 4/2011 |
| WO | 2012079971 | A1 | 6/2012 |
| WO | 2012113530 | A1 | 8/2012 |
| WO | 2012152622 | A1 | 11/2012 |
| WO | 2012172029 | A1 | 12/2012 |
| WO | 2013134665 | A1 | 9/2013 |
| WO | 2014190395 | A1 | 12/2014 |
| WO | 2015119988 | A1 | 8/2015 |
| WO | 2016203251 | A1 | 12/2016 |
| WO | 2017155946 | A1 | 9/2017 |
| WO | 2017187024 | A1 | 11/2017 |
| WO | 2018081419 | | 5/2018 |

* cited by examiner

FOIL FREE TABBED SEAL

CROSS-REFERENCE TO RELATED APPLICATIONS

This application is a U.S. national phase application filed under 35 U.S.C. § 371 of International Application Number PCT/US2020/062172, filed Nov. 25, 2020, designating the United States which claims benefit of U.S. Provisional Application No. 62/941,915, filed Nov. 29, 2019, which is hereby incorporated herein by reference in its entirety.

FIELD

The disclosure relates to pull-tab sealing members for sealing the mouth of a container, and more particularly, to pull-tab sealing members that are free from foil and other metal materials.

BACKGROUND

It is often desirable to seal the opening of a container using a removable or peelable seal, sealing member, or inner seal. Often a cap or other closure is then screwed or placed over the container opening capturing the sealing member therein. In use, a consumer typically removes the cap or other closure to gain access to the sealing member and then removes or otherwise peels the seal from the container in order to dispense or gain access to its contents.

Initial attempts at sealing a container opening utilized an induction- or conduction-type inner seal covering the container's opening where the seal generally conformed to the shape of the opening such that a circular container opening was sealed with a round disk approximately the same size as the opening. These prior seals commonly had a lower heat activated sealing layer to secure a periphery of the seal to a rim or other upper surface surrounding the container's opening. Upon exposing the seal to heat, the lower layer bonded to the container's rim. In many cases, these seals included a foil layer capable of forming induction heat to activate the lower heat seal layer. These prior seals tended to provide good sealing, but were often difficult for a consumer to remove because there was nothing for the consumer to grab onto in order to remove the seal. Often, the consumer needed to pick at the seal's edge with a fingernail because there was little or no seal material to grasp.

Other types of seals for containers include a side tab or other flange that extended outwardly from a peripheral edge of the seal. These side tabs are generally not secured to the container rim and provide a grasping surface for a consumer to hold and peel off the seal. These side tabs, however, extend over the side of the container rim and often protrude into a threaded portion of the closure. If the side tab is too large, this configuration may negatively affect the ability of the seal to form a good heat seal. The side tabs (and often the seal itself) can be deformed or wrinkled when the closure or other cap is placed on the container due to contact between the closure (and threads thereof) and tabbed part of the seal. To minimize these concerns, the side tabs are often very small; thus, providing little surface area or material for a consumer to grasp in order to remove the seal.

Yet other types of seals include a sealing member having a tab defined on the top of the seal. One approach of these prior seals includes a partial layer of coated pressure sensitive adhesive to secure the tab to a layer of metal foil. The tab was formed by a full layer extending across the entire surface of the sealing member, but the full layer was only bonded to half of the seal to form the tab. This type of top-tabbed seal offered the advantage of a larger tab, which provided more grasping area for the consumer to hold and peel off the seal, but required a full additional layer of material in order to form the tab. In other approaches, the seal may include a tab formed from the additional full layer of film combined with an additional full layer of adhesive utilizing a part paper or part polymer layer, called a tab stock, to form the tab. This part layer is inserted between the additional full layer of adhesive and lower seal portions to prevent the tab from sticking to the layers below, which formed the tab.

However, oftentimes such tabs are induction sealed to the container, thereby requiring an induction heating layer, such as a metal foil. Such metal foils complicate recycling efforts as the metal foil would need to be separated from the sealing member. Further, in some instances, a portion of the metal foil may remain on the container, thereby complicating recycling the container itself.

In this regard, such tabbed sealing members and the containers may be problematic, such as in Germany according to the "Duales System." The components would be considered composite materials, containing both plastics and metal foil. Such materials cannot be processed as a "mixed plastic film" such as by wind sifting according to the Duales System. Other countries are considering similar recycling systems and requirements such that the overall components used in a sealing member must be considered.

Therefore, it may be desirable to provide tabbed sealing members that are more suited for recycling according to different recycling systems and programs.

SUMMARY

Various forms of tabbed sealing members are described along with the laminates from which the sealing members are formed. In some forms, the tabbed sealing members may generally be formed from materials that may be processed using a single recycling stream. In one form, the tabbed seals do not include any metal foils, such as would traditionally be included in induction heated seals. Instead, the seals may be applied in other manners, such as using ultrasonic sealing, high frequency sealing, conduction heating, pressure sensitive adhesives, and the like.

According to one form, a tabbed sealing member for sealing to a rim surrounding a container opening is provided. The sealing member includes a multi-layer laminate including an upper laminate portion partially bonded to a lower laminate portion forming a gripping tab defined wholly within a perimeter of the sealing member. The gripping tab is configured for removing the sealing member from the container opening. The lower laminate portion is positioned below the gripping tab and includes at least a sealant layer for bonding to the container rim. The upper laminate portion includes a support layer. The tabbed sealing member is free of a metal foil layer.

In accordance with one form, a tabbed sealing member for sealing to a rim surrounding a container opening is provided. The sealing member includes a multi-layer laminate including an upper laminate portion partially bonded to a lower laminate portion forming a gripping tab defined wholly within a perimeter of the sealing member. The gripping tab is configured for removing the sealing member from the container opening. The lower laminate portion is positioned below the gripping tab and includes at least a sealant layer for bonding to the container rim. The sealant layer includes a polyolefin. The sealant layer may also comprise a polyester, such as polyethylene terephthalate. In some forms, other materials such as EVA, acrylics, and EMA materials may also be included in the sealant layer. The upper laminate portion including a polyolefin support layer. The tabbed sealing member is free of a metal foil layer.

In one form, a laminate for forming a tabbed sealing member is provided. The laminate includes an upper laminate portion and a lower laminate portion. The upper laminate portion includes a support layer. The lower laminate portion includes at least a sealant layer for bonding to the container rim. The upper laminate portion is partially bonded to a lower laminate portion and configured to form a gripping tab when the laminate is formed into the sealing member. The laminate is free of a metal foil layer.

According to one form, the support layer and the sealant layer each include a polyolefin.

In accordance with one form, the sealant layer is a pressure sensitive adhesive.

In one form, the upper laminate portion includes a tab layer.

According to one form, the tab layer is a printed layer.

In accordance with one form, the upper laminate portion includes a release layer.

In one form, the release layer is a lacquer layer.

According to one form, the sealant layer is a relatively low density and low melting point material compared to the support layer.

In accordance with one form, the support layer and the sealant layer each comprise polypropylene, polyethylene, or a combination thereof.

In one form, at least one of the support layer and the sealant layer comprises polyester.

According to one form, the support layer and the sealant layer each comprise polyester.

These and other aspects may be understood more readily from the following description and the appended drawings.

DETAILED DESCRIPTION

Figure 1:
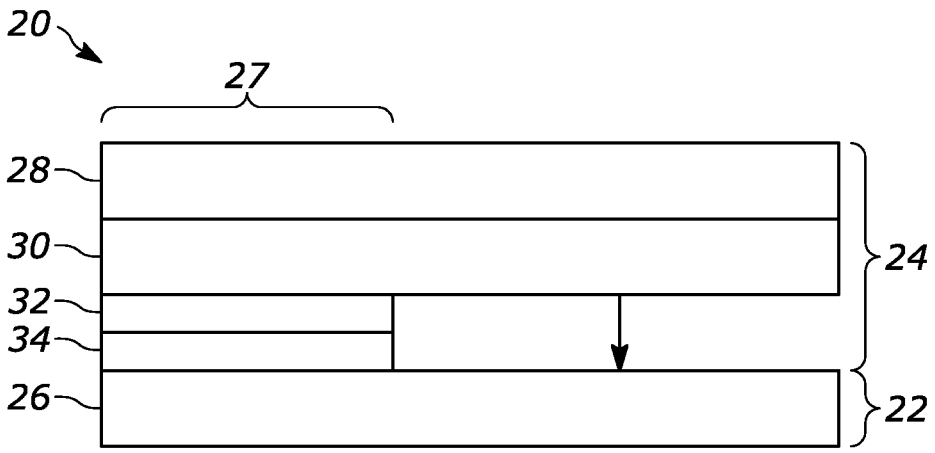
FIG. 1 is a cross-sectional view of one form of a tabbed sealing member that does not include a metal foil layer.

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

A pull tab sealing member for a container is described herein containing an upper laminate having a pull tab bonded to a lower laminate capable of being sealed to a container's mouth or opening. Generally, the sealing member is free from metal foil, such as aluminum foil, that would typically be used to induction seal to a container. Instead, many of the forms described herein may use alternative sealing technology, such as conduction heating, ultrasonic sealing, high frequency sealing, pressure sensitive adhesives, and the like.

For simplicity, this disclosure generally may refer to a container or bottle, but the sealing members herein may be applied to any type of container, bottle, package or other apparatus having a rim or mouth surrounding an access opening to an internal cavity. In this disclosure, reference to upper and lower surfaces and layers of the components of the sealing member refers to an orientation of the components as generally depicted in figures and when the sealing member is in use with a container in an upright position and having an opening at the top of the container. Different approaches to the sealing member will first be generally described, and then more specifics of the various constructions and materials will be explained thereafter. It will be appreciated that the sealing members described herein, in some cases, function in both a one-piece or two-piece sealing member configuration. A one-piece sealing member generally includes just the sealing member bonded to a container rim. A cap or closure may be also used therewith. A two-piece sealing member includes the sealing member temporarily bonded to a liner. In this construction, the sealing member is bonded to a container's rim, and the liner is configured to separate from the sealing member during heating to be retained in a cap or other closure used on the container. Alternatively, the bond between the liner and the sealing member may be frangible such that it separates when the lid is removed from the container by a user. In a two-piece construction, a wax layer, for example, may be used to temporarily bond the sealing member to a liner. Other types of releasable layers may also be used to provide a temporary bond between the seal and liner.

As discussed above, tabbed seals can suffer from problems associated with the use of metal foils in the tabbed sealing member. This can result in a combination of metal and polymer in the removed sealing member as well as remnant metal and polymer on the container once the sealing member is removed. These combinations of materials can lead to difficulties for recycling.

One form of a foil free tabbed sealing member is shown in FIG. 1. More specifically, FIG. 1 is a cross-section of tabbed sealing member 20 which is a multi-layer laminate. The tabbed sealing member 20 includes a lower laminate portion 22 partially bonded to an upper laminate portion 24 as shown at the arrow. A tab 27 is thereby formed for a user to grasp. The lower laminate portion 22 includes a sealant layer 26 for bonding to a container rim and, in some forms, may include one or more polymer layers. The upper laminate portion 24 includes at least one polymer layer, such as polymer layer 28 and polymer layer 30. The upper laminate portion 24 also includes an optional tab layer 32 and a release layer 34.

The sealant layer 26 may take a variety of forms. For example, sealant layer 26 may be a polyolefin film including, but not limited to, polypropylene, polyethylene, high density polyethylene, low density polyethylene, metallocene, polybutylene, and the like. In some forms, the sealant layer may comprise polyester materials. For example, the sealant layer may include a polyethylene terephthalate (PET) material, such as a PET heatseal lacquer. The material may be a co-polyester resin.

In some forms, the sealant layer may be applied to another layer, such as a support layer in the lower laminate portion. In some forms, the sealant layer may be modified such that it is suitable for use with certain types of materials. For example, when used with polyester containers, such as PET, the sealant may comprise polyester, such as PET. In other forms, the sealant layer may be used with polyolefin containers, such as polypropylene and/or polyethylene. In these forms, it may be more suitable that the sealant layer contains polypropylene and/or polyethylene to form a desirable bond.

In one form, the sealant layer 26 may have a relatively lower melting point, such as below about 110° C., below about 90° C., below about 80° C. The sealant layer 26 may also have a relative low density such as about 0.9 g/cm$^3$ to about 1.4 g/cm$^3$. In some forms, the sealant layer may have a thickness of about 1 μm to about 100 μm. In some forms, the sealant layer may be peelable (soft and/or hard). The sealant layer may also be forgiving and suitable for use with an oversealing device.

Further, the sealant layer 26 may be especially suited to other forms of sealing besides induction sealing since the tabbed sealing member does not include a foil layer. For example, the sealant layer 26 may be configured for ultrasonic sealing, conduction sealing, high frequency sealing, and the like.

In some forms, the sealant layer may be configured as a pressure sensitive adhesive. Such pressure sensitive adhesives may include about 0.2 to about a 0.5 mil (or less) adhesive, such as a coated ethylene vinyl acetate (EVA), polyolefins, 2-component polyurethane, ethylene acrylic acid copolymers, curable two part urethane adhesives, epoxy adhesives, ethylene methacrylate copolymers, and the like bonding materials.

The polymer layers, such as polymer layers 28 and 30, may take a variety of forms and perform a variety of different functions. For instance, in some forms, at least one of the polymer layers 28,30 may function as a support layer to provide structural stability. In some forms, at least one of the polymer layers 28,30 may function as an adhesive layer between the upper laminate portion 24 and lower laminate portion 22, such as indicated at the arrow in FIG. 1.

A variety of different materials can be used in polymer layers 28,30. For instance, polymer layer 28 may include polyolefin film, such as polypropylene, polyethylene, combinations thereof, and the like. In some forms, the material may be in the form as a monofilm or a coextruded film.

Polymer layer 30 may also include a variety of different materials. For instance, polymer layer 30 may include polyolefin film, such as polypropylene, polyethylene, HDPE, LLDPE, MDPE, LDPE, metallocene, polybutylene, combinations thereof, and the like. Further, the material may be a monofilm or coextruded film.

Polymer layers 28,30 may also take other forms, such as comprising polyester. For example, at least one of polymer layers 28,30 may comprise polyester terephthalate (PET). These materials can include plain PET films, PET coextruded films, heat sealable PET films, amorphous PET films, PET films having varying crystallinity, and the like. For instance, PET films having up to about 50% crystallinity may be used in some forms. In some forms, when provided in the lower laminate portion, the upper of the polymer layers may provide support and/or heat insulation while the lower polymer layer may provide compressibility and flexibility and a substrate for the sealant coating.

In one form, the polymer layers 28,30 in the upper laminate portion 24 are relatively higher melting point and/or higher density than polymers used in the lower laminate portion 22. For instance, the polymer layers 28,30 may have a melting point of about 115° C. to about 270° C. The polymer layers 28,30 may also have a density of about 0.90 g/cm$^3$ to about 1.4 g/cm$^3$. In some forms, polypropylene may be used, such as having a melting point of about 145° C. to about 170° C. and a density of about 0.90 g/cm$^3$ to about 0.93 g/cm$^3$.

The polymer layers may also be transparent, such as when forming one or more of the upper laminate. In this form, the transparent polymer layer in the upper laminate may permit other portions of the sealing member to be seen, such as when printing or other features are included.

The tab layer 32 may also take a variety of different forms and provide different properties, as desired. In one form, the tab layer can be a print layer. In general, the print layer can be applied to another layer, such as in the form of printing. Printing inks may be used including, but not limited to, nitrocellulose, PVD (physical vapor deposition) pigments, acrylic, polyurethane, polyvinyl butyral, (PVB) and the like. In some forms, the print layer is applied to one of the polymer layers 28,30. In other forms, the print layer 32 may be applied to a different layer, such as a polymer layer, which is then combined with one or more of the polymer layers 28,30.

The release layer 34 can generally be included to permit a part of the lower and upper laminate portions 22,24 to be separate or otherwise separate from one another by a user. The release layer 34 can take a variety of forms such as films, coatings, and the like. In one form, the release layer can be a silicon coating. According to one form, the release layer 34 can be a lacquer layer. The release layer 34 may also include polyamide coatings, nitrocellulose/polyamide blends, polyurethane resin coatings, acrylic resins, and the like. In some forms, the release layer is a physical separation as opposed to an anti-sticking layer, such as with silicon. In this regard, a physical non-melting layer may be suitable as a release layer.

Figure 2:
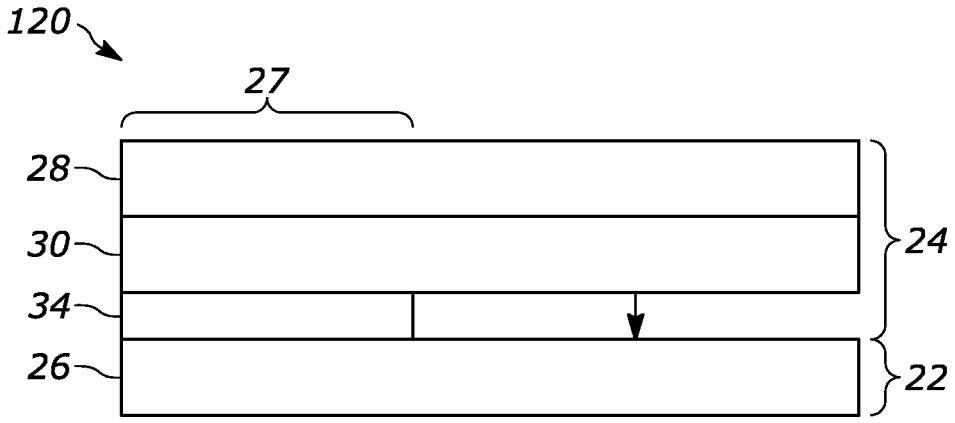
FIG. 2 is a cross-sectional view of another form of a tabbed sealing member that does not include a metal foil layer.

Another form of tabbed sealing member is shown in FIG. 2. Tabbed sealing member 120 generally includes similar features as described above. However, in this form, the tabbed sealing member 120 does not include printed layer 32. In some forms, the release layer 34 can be made thicker or thinner as desired and to provide a suitable grasping surface for a user.

Figure 3:
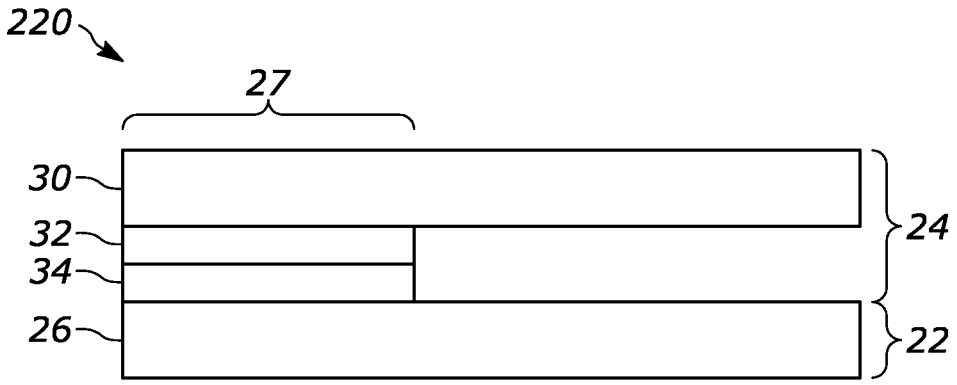
FIG. 3 is a cross-sectional view of another form of a tabbed sealing member that does not include a metal foil layer.

FIG. 3 provides an illustration of tabbed sealing member 220. This form is similar to the form found in FIG. 1. However, tabbed sealing member 220 includes a single polymer layer 30. In this form, polymer layer 30 can function at least as a support layer providing sufficient strength for a user to grasp the tab 27 and remove at least a portion of the tabbed sealing member 220.

Figure 4:
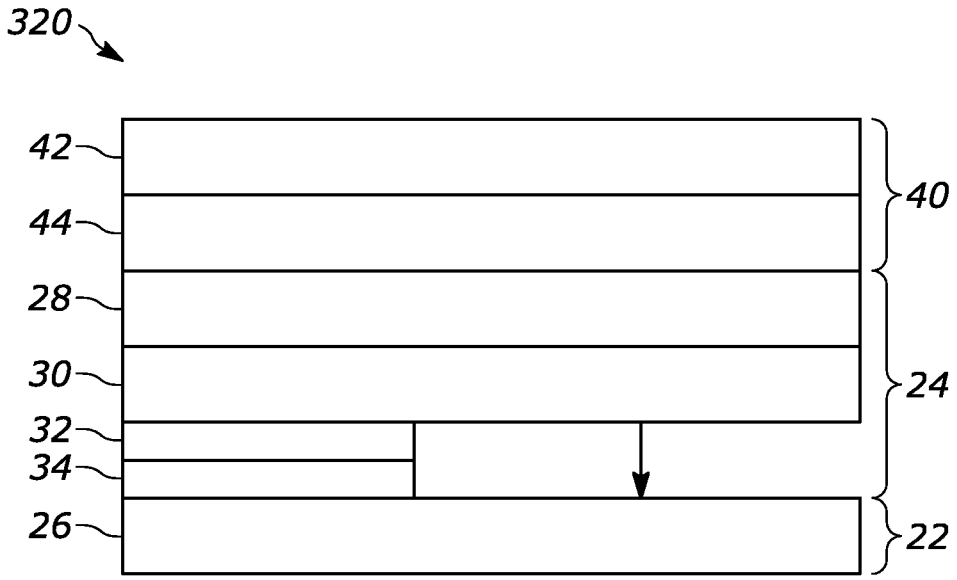
FIG. 4 is a cross-sectional view of one form of a tabbed sealing member having a two-piece construction.

A two-piece configuration is shown in FIG. 4. Generally, this form can include any of the different combination of features described herein along with a liner portion 40. More specifically, tabbed sealing member 320 includes a liner portion 40 that comprises a backing layer 42 and a temporary bonding layer 44. The temporary bonding layer 44 can take a variety of forms and provide temporary bonding to the upper laminate portion 24 in a variety of manners. In one form, the temporary bonding layer 44 may take the form of a wax that can be absorbed into one of the backing layer 42 and the upper laminate portion 24. For example, backing layer 42 may be a paper or pulp layer such that when tabbed sealing member 320 is heated and installed onto a container, the wax can melt and be absorbed. In another form, the temporary bonding layer can simply provide a frangible bond that can be easily broken, such as when a closure is removed from the container.

Figure 5:
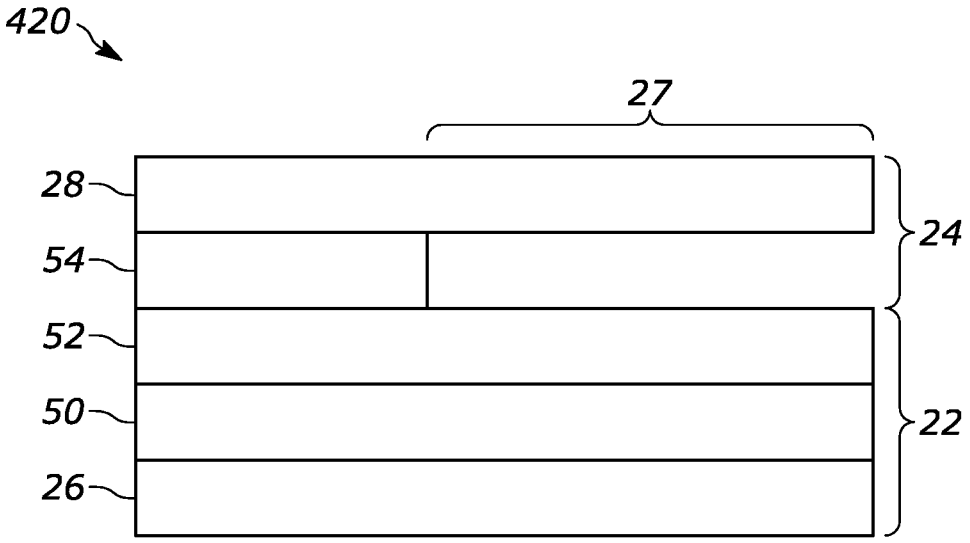
FIG. 5 is a cross-sectional view of one form of a tabbed sealing member.

FIG. 5 illustrates another form of a sealing member 420. This form is similar to a number of the embodiments described above. FIG. 5 differs in that various polymer layers are included in the lower laminate portion 22. More specifically, lower laminate includes sealant layer 26 along with polymer layer 50, and polymer layer 52. A partial adhesive layer 54 is positioned to form a partial bond, providing tab portion 27. The upper laminate includes polymer layer 28.

One exemplary form for the features of FIG. 5 will now be described. In some forms, each of the layers in the sealing member may comprises a common type of material. For example, each of the layers may comprise a form of polyester, such as PET. In some forms, the sealant layer 26 may be a PET heat seal lacquer. The PET heat seal lacquer can be applied to various PET containing materials in the polymer layer 50. For instance, polymer layer 50 may be a PET film that is chemically treated, such as an acrylic treatment. Other treatments may include, but are not limited to, corona treatment, co-polyester treatment, and the like. Further, polymer layer 52 may comprise a polyester material, such as an amorphous PET material.

Amorphous PET may be especially useful in certain seals as it may provide compressibility, replacing some of the function of foams that are traditionally used in sealing members. Further, PET materials, may have a pigment to protect the contents of the container from light. PET materials are generally fairly stiff, but amorphous PET may be used to provide some compression and flexibility in the sealing member.

While not shown in FIG. 5, an adhesive, such as a two-part polyurethane adhesive may be used between polymer layers 50 and 52. Similarly, partial adhesive layer 54 may be a two-part polyurethane adhesive. Finally, the polymer layer 28 may be a transparent PET film.

Figure 6:
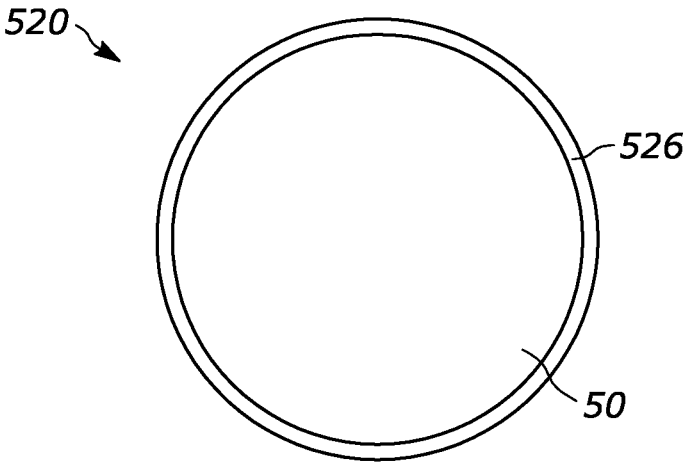
FIG. 6 is a bottom view of one form of a tabbed sealing member showing a heat seal that has been applied in registration with the sealing member.

FIG. 6 illustrates another form of sealing member 520. As shown in FIG. 6, a sealant layer 526 is applied in registration with the size and shape of the sealing member 520. In this form, the sealant layer 526 is applied in the area of the sealing member that will contact and seal to the rim of a container when installed. As such, when viewed from the bottom, the sealant layer 526 is shown towards the edge of the sealing member 520 while layers above the sealant layer are shown in areas which generally are not positioned above the rim of the container. For example, in a configuration similar to FIG. 5, polymer layer 50 is visible from the bottom of the sealing member. When preparing such a sealing member, the sealant layer 526 can be applied only in specific areas on the polymer layer 50, when in the form of a laminate or sheet. Then, when the laminate or sheet is cut, the cuts are made in registration with the location of the sealant layer 526. This provides for sealant layer 526 being generally just positioned towards an outer edge of the sealing member 520 in locations where the sealing member would contact and seal the container. It should be appreciated that this application of sealant layer in registration with the sealing member may be used and applied to any of the embodiments described above.

In some forms, it should be understood that many and/or all of the layers in the sealing members comprise a common form of material. For example, the layers may generally comprise polyolefins. In some forms the layers may generally comprise polyesters, such as PET. In some forms, the layers, with the exception of the sealant layer, may comprise a common form of material. For instance, the polymer layers of the sealing member may comprise polyesters, such as PET while the sealing member may comprise polyolefin, such as polypropylene and/or polyethylene. In this form, a majority of the sealing member may be considered as a mono-material, from the same type of material, with the exception of the sealant layer.

Mono-material sealing members may be especially suitable for recycling purposes. Further, a mono-material system may be utilized with common polymer layers used for different types of seals where only the sealant layer is modified. One such example may include a polyester mono-material sealing member where each of the polymer layers comprise a form of PET. In the case where the mono-material system is used on PET containers, the sealant layer may also comprise PET. In the case where the mono-material system is used with polypropylene, the polymer layers would still comprise the same PET materials, but the sealant layer would comprise polypropylene instead of PET. This system may be useful where the same polymer layers are used for different types of seals, only having to modify the sealant layer, as needed. Other types of mono-material systems may be configured in a similar manner, such as polyolefin mono-material systems with varying sealant layers.

When used in mono-material sealing systems, the sealant layer may be applied in registration with the sealing member, as described above, to minimize the amount of any alien materials. For example, in a PET mono-material sealing system, a polypropylene sealant layer may be applied in registration, as described above, to minimize the amount of any non-PET materials. This can increase the use as a recyclable stream.

It should be appreciated that various adhesives may be included in the layer described above for the various embodiments. For example, adhesives and/or adhesive layers may be provided between the various polymer layers, as needed.

Figure 7:
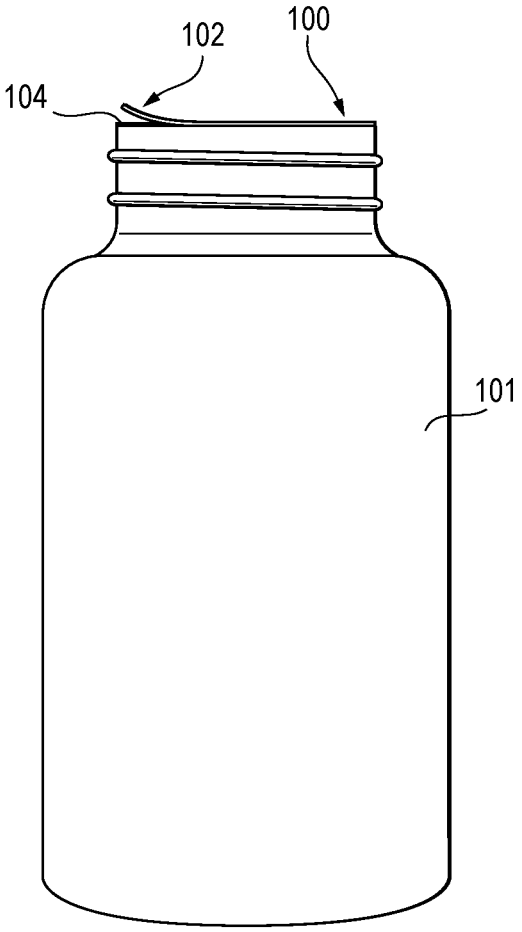
FIG. 7 is a side view of one form of a tabbed sealing member installed on a container.
Figure 8:
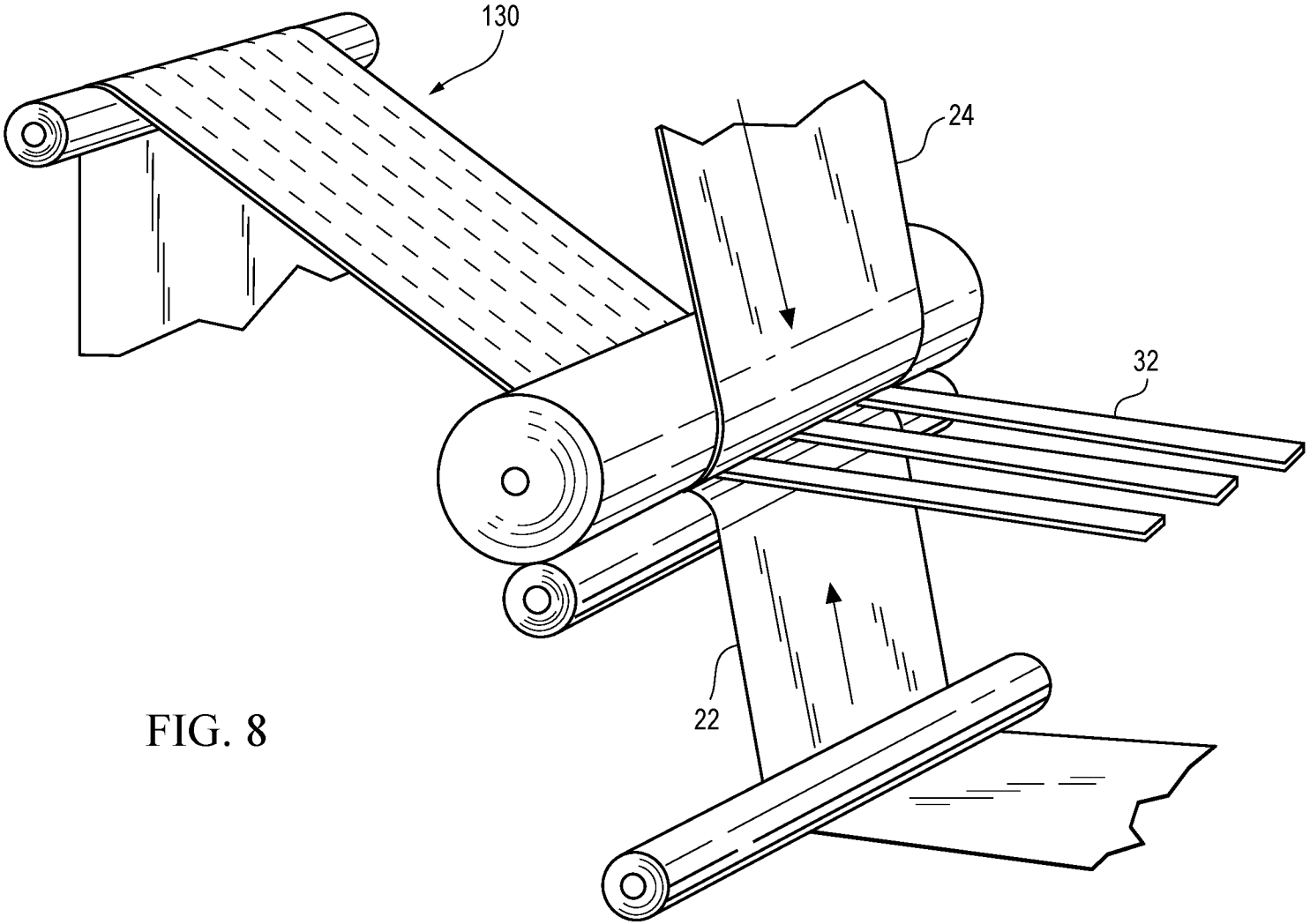
FIG. 8 is a perspective view of one form of assembling a laminate used to form a tabbed sealing member.

A tabbed sealing member 100 is shown as installed on a container 101. Tabbed sealing member 100 can include any of the embodiments described above as well as combinations of features from the embodiments. As shown in FIG. 7, a tab 102 is being lifted away from a lower laminate portion 104 that is sealed on the container 101. A user can grasp the tab 102 to remove at least a portion of the tabbed sealing member 100 from the container 101.

One form of assembling tabbed sealing members is shown in FIG. 6. In this form, the upper laminate portion 24 is joined to the lower laminate portion 22 with the printed layer 32 therebetween. It should be appreciated that the release layer 34 can also or alternatively be positioned therebetween. In some forms, the upper laminate portion can be pre-formed, such as using higher density, higher melting point materials adhered to one another in a separate bonding process. This pre-formed material can then be adhered to the lower laminate portion using a heat lamination process using heated rollers and/or using a separate adhesive.

The layers may also be assembled in other manners. For example, in addition to heat lamination, other adhesives or lamination materials may be used. Polyurethane adhesive lamination may be used between one or more layers and may also include a strip of such material that is applied, such as on or adjacent the release lacquer. Similarly, partial application of polyurethane adhesive may be used between one or more layers. Other partial applications may also be used with other materials such as hot melt adhesives, low melt co-polyesters, and the like.

In some forms, the tabbed sealing members described herein may be more suitable for recycling. For instance, the tabbed sealing members are free from metal foils that may otherwise contaminate or complicate the recycling process of the tabbed sealing member and/or container. In some traditional sealing members, at least a portion of the foil layer may remain on the container and/or with the seal when the seal is removed. The metal foil typically cannot be recycled with the polymer layers such that it must be removed or the overall material cannot be recycled. Further, in some forms, the tabbed sealing member may be made substantially from the same type of polymer material such that the seal can be recycled in a single process or otherwise easily separated into the component layers. For example, the layers can include polyolefins and similar materials that can be recycled.

According to one form, the sealant layer is a low density, low melting point material that does not require significant heat to adhere to a container. Such materials may include, but are not limited to, co-extruded polypropylene and a random copolymer. Other layers in the tabbed sealing member may be relatively higher density and higher melting point such that they do not melt during the heating process for applying the sealing member to a container.

The tabbed sealing members described herein, in some forms, may be prepared such that they do not require a specific tab layer, such as a PET layer, as used in many traditional tabbed seals. This can lower costs and/or provide for thinner laminates.

Similarly, in some forms, PET layers can be eliminated from the upper laminate portion, as desired. Instead, PET layers in the upper laminate portion can be replaced with other materials, such as co-extruded polypropylene. This can also help improve the recyclability of the tabbed sealing member. As noted above, substantially the entire tabbed sealing member can include polyolefin layers, such as polypropylene and/or polyethylene.

It should be appreciated that layers described herein may be a combination of two or more materials, such as a co-extrusion of multiple materials whereby a first material is an adhesive and a second material may provide extra support and/or strength.

By eliminating the metal foil layer from the tabbed sealing member, it may be possible to provide a seal whereby the internal contents of the container are visible when the tab is lifted.

In some forms, since the lower laminate portion 22 does not include an induction heating layer, the lower laminate may or may not provide sufficient barrier properties. Such barrier properties include, but are not limited to, oxygen barrier, moisture barrier, and the like. However, in some forms it may be desirable to increase these properties without adding a metal foil layer. In such forms, barrier films and/or coatings may be used. Such materials include, but are not limited to SiOx, AlOx, EVOH, and combinations thereof.

As described above, the upper and lower laminate portions may include a variety of layers. The layers may include different polymer materials, such as films, foams, papers, combinations thereof, and the like. The layers could be built using various backings, various HDPE foams at a variety of different densities. Other paper or fibrous materials could also be used in the upper laminate for insulation since fracture strength is no longer an issue compared to the lower laminate portion.

Further general details of the tabbed seals and layers are provided below.

Additional layers may be included in the upper and/or lower laminate such as polyethylene terephthalate (PET), nylon, or other structural polymer layer and may be, in some approaches, about 0.5 to about 1 mil thick. In some approaches, additional layers may be included in the lower laminate. It should be appreciated that the lower seal laminate may include any number of other layers, such as polymer layers, adhesives, polymer films, polymer foams and the like.

The lower sealant or heat seal layer may be composed of any material suitable for bonding to the rim of a container, such as, but not limited to, induction, conduction, or direct bonding methods. Suitable adhesives, hot melt adhesives, or sealants for the heat sealable layer include, but are not limited to, polyesters, polyolefins, ethylene vinyl acetate, ethylene-acrylic acid copolymers, surlyn, and other suitable materials. By one approach, the heat sealable layer may be a single layer or a multi-layer structure of such materials about 0.2 to about 3 mils thick. By some approaches, the heat seal layer is selected to have a composition similar to and/or include the same polymer type as the composition of the container. For instance, if the container includes polyethylene, then the heat seal layer would also contain polyethylene. If the container includes polypropylene, then the heat seal layer would also contain polypropylene. Other similar materials and combinations are also possible.

The polymer layers used in the upper and/or lower laminates may take a variety of forms such as coatings, films, foams, and the like. Suitable polymers include but are not limited to, polyethylene, polypropylene, polyester, ethylene-propylene copolymers, blends thereof as well as copolymers or blends with higher alpha-olefins. By one approach, one or more of the polymer layers may be a blend of polyolefin materials, such as a blend of one or more high density polyolefin components combined with one or more lower density polyolefin components. In one form, one polymer layer may be a polyethylene film while another polymer layer may be a PET film. According to one form, the polyethylene film may have a thickness of about 5 to about 20 microns while the PET film may have a thickness of about 5 to about 20 microns.

A support layer may be optional in the laminate. If included, it may be polyethylene terephthalate (PET), nylon, or other structural polymer layer and may be, in some approaches, about 0.5 to about 1 mil thick.

In some forms, the seals may include an insulation layer or a heat-redistribution layer. In one form, the insulation layer may be a foamed polymer layer. Suitable foamed polymers include foamed polyolefin, foamed polypropylene, foamed polyethylene, polyester foams, amorphous polyesters, and the like. In some forms, these foams generally have an internal rupture strength of about 2000 to about 3500 g/in. In some approaches, the foamed polymer layer 106 may also have a density less than 0.6 g/cc and, in some cases, about 0.4 to less than about 0.6 g/cc. In other approaches, the density may be from about 0.4 g/cc to about 0.9 g/cc. The foamed polymer layer may be about 1 to about 5 mils thick.

In other approaches, a non-foam heat distributing or heat redistributing layer may be included. In such approach, the non-foam heat distributing film layer is a blend of polyolefin materials, such as a blend of one or more high density polyolefin components combined with one or more lower density polyolefin components. Suitable polymers include but are not limited to, polyethylene, polypropylene, ethylene-propylene copolymers, blends thereof as well as copolymers or blends with higher alpha-olefins. By one approach, the non-foam heat distributing polyolefin film layer is a blend of about 50 to about 70 percent of one or more high density polyolefin materials with the remainder being one or more lower density polyolefin materials. The blend is selected to achieve effective densities to provide both heat sealing to the container as well as separation of the liner from the seal in one piece.

The heat-activated bonding layer may include any polymer materials that are heat activated or heated to achieve its bonding characteristics or application to the seal. By one approach, the heat-activated bonding layer may have a density of about 0.9 to about 1.0 g/cc and a peak melting point of about 145° F. to about 155° F. A melt index of the bonding layer 120 may be about 20 to about 30 g/10 min. (ASTM D1238). Suitable examples include ethylene vinyl acetate (EVA), polyolefin, 2-component polyurethane, ethylene acrylic acid copolymers, curable two-part urethane adhesives, epoxy adhesives, ethylene methacrylate copolymers, polybutylene, combinations thereof, and the like bonding materials.

The adhesives useful for any of the adhesive or tie layers described herein include, for example, ethylene vinyl acetate (EVA), polyolefins, 2-component polyurethane, ethylene acrylic acid copolymers, curable two-part urethane adhesives, epoxy adhesives, ethylene methacrylate copolymers, polybutylene, copolyesters, combinations thereof, and the like bonding materials. Other suitable materials may include low density polyethylene, ethylene-acrylic acid copolymers, and ethylene methacrylate copolymers. By one approach, any optional adhesive layers may be a coated polyolefin adhesive layer. If needed, such adhesive layers may be a coating of about 0.2 to about a 0.5 mil (or less) adhesive, such as coated ethylene vinyl acetate (EVA), polyolefins, 2-component polyurethane, ethylene acrylic acid copolymers, curable two-part urethane adhesives, epoxy adhesives, ethylene methacrylate copolymers, copolyesters, and the like bonding materials.

In one aspect, the tab may be formed by a full layer or partial layer of material combined with a partial width composite adhesive structure that includes a polyester core with upper and lower adhesives on opposite sides thereof. This partial composite adhesive structure bonds the upper laminate to the lower laminate to form the gripping tab.

In other aspects of this disclosure, the upper laminate of the seal does not extend the full width of the sealing member in order to define the gripping tab. To this end, the pull tab sealing members herein may also combine the advantages of a tabbed sealing member with a large gripping tab defined completely within the perimeter of the seal, but achieve such functionality with less material (in view of the part layers of the upper laminate) and permit such a tab structure to be formed on many different types of pre-formed lower laminates. The partial upper laminate structure is advantageous, in some approaches, for use with a seal configured for large or wide mouth containers, such as containers with an opening from about 30 to about 100 mm (in other approaches, about 60 to about 100 mm). These seals may also be used with 38 mm or 83 mm container openings, or can be used with any sized container.

In further aspects of this disclosure, the sealing members herein may include a pull or grip tab defined in the upper laminate portion wholly within a perimeter or circumference of the sealing member wherein an upper surface of the sealing member is partially defined by the upper laminate portion and partially defined by the lower laminate portion. In one approach of this aspect, the top surface of the sealing member is provided by a minor portion of the upper laminate and a major portion of the lower laminate. In other approaches of this aspect, the lower laminate is partially exposed at a top surface of the seal with about 50 percent to about 75 percent (or more) of the lower laminate exposed at the top surface of the entire seal. The seals of this aspect allow consumers to remove the sealing member using the tab (as in a conventional pull tab seal) and/or puncture the sealing member by piercing the exposed lower laminate portion to provide push/pull functionality depending on the preference of the consumer.

In the various embodiments, the seals of the present disclosure defining a tab wholly within a perimeter or circumference of the seal (formed by a full or partial layer) also provide an improved ability for the tabbed sealing member to function in a two-piece seal and liner combination. In a two-piece seal and liner combination, the tabbed sealing member is temporarily adhered across its top surface to a liner. After container opening and removal of a cap or closure, the sealing member stays adhered to the container mouth and the liner separates and remains in the container's cap.

In some prior versions of two-piece seal and linear assemblies, the bottom layer of the sealing member is a heat seal layer that is activated by heating, such as by induction or conduction heating, in order to adhere or bond an outer periphery of the sealing member to a rim surrounding the mouth of a container. In the two-piece seal and liner combination, an upper surface of the sealing member is temporarily adhered to a lower surface of the liner by a release layer, which is often a heat-activated release layer, such as an intervening wax layer. During heating to bond the sealing member to the container, heat not only activates the lower heat seal layer, but also travels upwardly through the seal to melt the intervening wax across the entire surface of the sealing member to separate the liner from the sealing member. Often, the melted wax is absorbed by the liner in order to permit easy liner separation from the sealing member. As can be appreciated, for this sealing member and liner combination to function properly, the intervening wax layer needs to be melted across the entire surface of the sealing member. If the wax is not melted evenly all the way across the sealing member upper surface, the liner may not properly separate from the lower seal portion.

The various layers of the sealing member are assembled via coating adhesives, applying films, and/or a heat lamination process forming a sheet of the described layers. Extrusion lamination may also be used. The resulting laminate sheet of the sealing members can be cut into appropriate sized disks or other shapes as needed to form a vessel closing assembly or tabbed sealing member. The cut sealing member is inserted into a cap or other closure which, in turn, is applied to the neck of a container to be sealed. The screw cap can be screwed onto the open neck of the container, thus sandwiching the sealing member between the open neck of the container and the top of the cap. The sealing layer may be a pressure sensitive adhesive, the force of attaching the closure to the container can activate the adhesive.

EXAMPLES

One form of a mono-material sealing member system may be formed from polyester materials, such as PET materials. In the lower laminate portion, a 12 micron PET film that has been acryl treated has a 3 gsm PET heat seal lacquer applied on the treated side of the film. On the opposite side of the PET film is a two-part polyurethane adhesive that secures a 250 micron amorphous PET layer. A partial adhesive layer comprising two-part polyurethane is used to secure a 36 micron PET transparent film to the amorphous PET layer, thereby forming the tab portion therebetween.

Another form of mono-material sealing member may be formed generally from polypropylene materials. The upper laminate includes 50 micron coextruded three layer oriented polypropylene (OPP) that is partially adhered to the lower laminate portion through a two-part polyurethane that is partially applied to create the tab layer. The lower laminate portion includes a 75 micron cast polypropylene (CPP) that can be a monolayer and also may have a color, such as white. This layer may be used to provide compressibility. Below that, a 40 micron two-part polyurethane adhesive can be used to adhere to a coextruded three layer cast polypropylene (CPP) with a co-polymer blend in the heat seat. A further polypropylene layer may also be included, such as a 16 micron polypropylene that is coated with aluminum oxide. This layer can be included in the lower laminate portion and can provide for oxygen and water barrier properties. The aluminum oxide layer is typically very thin, such as in the angstrom range and is not visible.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A tabbed sealing member for sealing to a rim surrounding a container opening, the sealing member comprising:

a multi-layer laminate including an upper laminate portion partially bonded to a lower laminate portion forming a gripping tab, the gripping tab configured for removing the sealing member from the container opening, the lower laminate portion positioned below the gripping tab and including at least a sealant layer for bonding to the container rim, the upper laminate portion including a support layer, and the tabbed sealing member being free of a metal foil layer, wherein the sealing member is mono-material with each of the layers in the sealing member, with the exception of the sealant layer, being made from the same type of material.

2. The tabbed sealing member of claim 1, wherein the support layer and the sealant layer each comprise a polyolefin.

3. A tabbed sealing member for sealing to a rim surrounding a container opening, the sealing member comprising:

a multi-layer laminate including an upper laminate portion partially bonded to a lower laminate portion forming a gripping tab, the gripping tab configured graspable by a user for removing the sealing member from the container opening, the lower laminate portion positioned below the gripping tab and including at least a sealant layer for bonding to the container rim, the upper laminate portion including a support layer forming at least a portion of the gripping tab, and the tabbed sealing member being free of a metal foil layer, wherein the support layer and the sealant layer each comprise a polyester such that at least a portion of the gripping tab is polyester.

4. The tabbed sealing member of claim 1, wherein the upper laminate portion includes a print layer.

5. The tabbed sealing member of claim 4, wherein the print layer is a tab layer.

6. The tabbed sealing member of claim 1, wherein the lower laminate portion includes a polymer layer.

7. The tabbed sealing member of claim 6, wherein polymer layer comprises an amorphous polyethylene terephthalate.

8. The tabbed sealing member of claim 6, wherein the polymer layer comprises a chemically treated polyethylene terephthalate.

9. The tabbed sealing member of claim 1, wherein the support layer and the sealant layer each comprise polypropylene, polyethylene, or a combination thereof.

10. The tabbed sealing member of claim 1, wherein the sealant layer is positioned at an outer periphery of the sealing member such that it is in registration with the rim of the container when installed.

11. A tabbed sealing member for sealing to a rim surrounding a container opening, the sealing member comprising:

a multi-layer laminate including an upper laminate portion partially bonded to a lower laminate portion forming a gripping tab, the gripping tab configured for removing the sealing member from the container opening, the lower laminate portion positioned below the gripping tab and including at least a sealant layer for bonding to the container rim and at least one polymer layer, the polymer layer comprising polyester, the upper laminate including a support layer comprising polyester, and the tabbed sealing member being free of a metal foil layer, wherein the sealing member is mono-material with each of the layers in the sealing member, with the exception of the sealant layer, being made from the same type of material.

12. The tabbed sealing member of claim 11, wherein the sealant layer comprises polyester.

13. The tabbed sealing member of claim 11, wherein the sealant layer comprises polyolefin.

14. The tabbed sealing member of claim 11, wherein the upper laminate portion includes a print layer.

15. The tabbed sealing member of claim 14, wherein the print layer is a tab layer.

16. The tabbed sealing member of claim 11, wherein polymer layer comprises an amorphous polyethylene terephthalate.

17. The tabbed sealing member of claim 11, wherein the lower laminate portion further includes a second polymer layer, the second polymer layer comprising a chemically treated polyethylene terephthalate.

18. The tabbed sealing member of claim 11, wherein the support layer in the upper laminate portion is a transparent polyester terephthalate film.

19. The tabbed sealing member of claim 11, wherein the sealant layer is positioned at an outer periphery of the sealing member such that it is in registration with the rim of the container when installed.

20. A laminate for forming a tabbed sealing member, the laminate comprising:

an upper laminate portion including a support layer; and a lower laminate portion including a sealant layer for bonding to the container rim and at least one polymer layer, the upper laminate portion partially bonded to a lower laminate portion and configured to form a gripping tab when the laminate is formed into the sealing member, the laminate being free of a metal foil layer, wherein the laminate is mono-material with each of the layers in the laminate, with the exception of the sealant layer, being made from the same type of material.

21. The laminate of claim 20 wherein the support layer comprises polyester and the polymer layer comprises polyester.

22. The tabbed sealing member of claim 1, further comprising a partial adhesive layer positioned between the upper laminate portion and the lower laminate portion forming the gripping tab.

23. The tabbed sealing member of claim 1, wherein the sealant layer is a pressure sensitive adhesive.

* * * * *